US007017282B2

(12) United States Patent
Pyo et al.

(10) Patent No.: US 7,017,282 B2
(45) Date of Patent: Mar. 28, 2006

(54) DRYING APPARATUS AND WASHING MACHINE HAVING THE SAME

(75) Inventors: Sang-Yeon Pyo, Suwon (KR); Hyung-Gyoon Kim, Suwon (KR); Byoung Yull Yang, Ansan (KR); Dong Hyun Lee, Suwon (KR); Kyu Sun Lee, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/800,730

(22) Filed: Mar. 16, 2004

(65) Prior Publication Data

US 2005/0016010 A1 Jan. 27, 2005

(30) Foreign Application Priority Data

Jul. 24, 2003 (KR) ..... 10-2003-0050977
Sep. 9, 2003 (KR) ..... 10-2003-0063001

(51) Int. Cl.
*F26B 11/02* (2006.01)

(52) U.S. Cl. ..... 34/596; 68/18 C

(58) Field of Classification Search ..... 34/469, 34/73, 77, 78, 596; 68/18 C, 20
See application file for complete search history.

(56) References Cited

U.S. PATENT DOCUMENTS 3,274,807 A * 9/1966 Czech ..... 68/12.09
4,135,370 A 1/1979 Hosoda et al. ..... 62/274
4,154,003 A * 5/1979 Muller ..... 34/469
5,146,693 A * 9/1992 Dottor et al. ..... 34/77
5,606,878 A * 3/1997 Arreghini et al. ..... 68/17 R
5,768,730 A * 6/1998 Matsumoto et al. ..... 8/159

FOREIGN PATENT DOCUMENTS

| | | | |
|---|---|---|---|
| EP | 0 485 700 | 8/1991 | |
| EP | 0 777 998 | 6/1997 | |
| JP | 04-371198 | 12/1992 | ..... 58/2 |
| JP | 2002-346274 | 12/2002 | |

* cited by examiner

*Primary Examiner*—S. Gravini
(74) *Attorney, Agent, or Firm*—Staas & Halsey LLP

(57) ABSTRACT

A washing machine including a drying apparatus. The washing machine including the drying apparatus quickly dries wet laundry by efficiently condensing and adsorbing vapor from humid air of high temperature flowing from a water tub during a drying-mode operation. The drying apparatus includes a condensing duct and a blower duct respectively mounted on a rear surface and an upper surface of the water tub. The condensing duct has an ultrasonic atomizing unit, a condensing unit and a water adsorption unit therein, while the blower duct has a blower fan and a heater therein. An inner space of the condensing duct is partitioned into a first condensing path, a second condensing path and a third condensing path by a first air guide and a second air guide. The ultrasonic atomizing unit, the condensing unit and the water adsorption unit are installed in the first condensing path, the second condensing path and the third condensing path of the condensing duct, respectively, thus condensing and adsorbing vapor from the humid air which sequentially passes through the first to third condensing paths, thereby dehumidifying the air providing dry air which is fed to the water tub to dry the wet laundry.

7 Claims, 7 Drawing Sheets

DRYING APPARATUS AND WASHING MACHINE HAVING THE SAME

CROSS-REFERENCE TO RELATED APPLICATIONS

This application claims the benefit of Korean Application No. 2003-50977, filed Jul. 24, 2003 and Korean Application No. 2003-63001, filed Sep. 09, 2003, in the Korean Intellectual Property Office, the disclosures of which are incorporated herein by reference.

BACKGROUND OF THE INVENTION

1. Field of the Invention

The present invention relates, in general, to washing machines having drying apparatuses to dry laundry and, more particularly, to a washing machine having a drying apparatus, in which the drying apparatus quickly dries hot, humid air flowing from a water tub during a drying-mode operation, thus reducing a drying time and saving electricity while drying laundry during the drying-mode operation.

2. Description of the Related Art

Generally, washing machines are classified into vertical shaft-type washing machines in which a rotary tub is installed in a cabinet along a vertical axis of the cabinet, and drum-type washing machines in which a rotary tub is installed in a cabinet along a horizontal axis of the cabinet. To dry wet laundry after washing, some conventional washing machines have drying apparatuses, regardless of the types of the washing machines. For ease of description, the present invention relating to the drying apparatus will be described herein below, with reference to drum-type washing machines having drying apparatuses.

In a conventional drum-type washing machine, a rotary tub horizontally set in a cabinet is rotated around a horizontal axis of the cabinet in opposite directions, thus repeatedly moving laundry, seated on an internal surface of the rotary tub, upward together with washing water. Eventually, the laundry rises and drops from a raised position to a bottom in an interior of the rotary tub due to gravity, and thereby washing the laundry.

The conventional drum-type washing machine further includes a water tub installed in the cabinet and containing washing water therein, with the rotary tub rotatably installed in the water tub to wash the laundry. A door is mounted by a hinge to a front surface of the cabinet allowing a user to place and remove the laundry into and from the rotary tub. The conventional drum-type washing machine further includes a drying apparatus to dry the wet laundry after the laundry has been washed, rinsed and spin-dried.

The conventional drying apparatus for the drum-type washing machines includes an air duct provided on an outer surface of the water tub forming an air circulation circuit, in cooperation with an interior of the water tub, so that air used to dry the wet laundry circulates through the air circulation circuit which is a closed system, during a drying-mode operation of the drying apparatus. A blower fan and a heater are installed in the air duct. The conventional drying apparatus for the drum-type washing machines further includes a condensing nozzle provided in the air duct to condense vapor in the high temperature humid air produced while the air passed through the wet laundry to dry the laundry. In brief, the condensing nozzle of the drying apparatus sprays water from a plurality of spraying holes thereof to the humid air condensing the vapor from the air, thus dehumidifying the air while reducing the temperature of the air. Therefore, the condensing nozzle provides dry air of low temperature.

In the conventional drum-type washing machine, a drying-mode operation to dry the wet laundry is executed by the drying apparatus after the laundry within the rotary tub has been completely washed, rinsed and spin-dried through a washing-mode operation, a rinsing-mode operation and a spin-drying-mode operation. To dry the wet laundry, both the blower fan and the heater installed in the air duct of the drying apparatus are turned on, so that the dry air of low temperature from the condensing nozzle flows to the heater of the drying apparatus. The heater thus heats the dry air of low temperature making the dry air of high temperature. Thereafter, the dry air of high temperature passes through the wet laundry placed in the rotary tub, changing into humid air of high temperature while absorbing water from the wet laundry. Thereafter, the humid air of high temperature flows to the condensing nozzle, so that the air is dehumidified providing dry air of low temperature again. The above-mentioned circulation of the air in the air circulation circuit continues for a lengthy predetermined period of time drying the wet laundry placed in the rotary tub.

However, because the conventional drying apparatus for the drum-type washing machines has a single air path extending from a lower end to an upper end of the air duct having the condensing nozzle, the conventional drying apparatus has the following problems. Due to the single air path within the air duct, the humid air of high temperature flowing into the air duct contacts water sprayed from the condensing nozzle, thus being dehumidified. Therefore, the conventional drying apparatus does not efficiently condense the vapor from the humid air within a limited time, so the drying efficiency of the conventional drying apparatus is remarkably reduced.

Furthermore, in the conventional drying apparatus for the drum-type washing machines, the spraying holes of the condensing nozzle are open downward, so that water is sprayed downward from the spraying holes coming into contact with the humid air. The condensing efficiency of the condensing nozzle is thus reduced.

Furthermore, when a pressure of the water which is fed to the condensing nozzle of the conventional drying apparatus is low, water droplets produced by spraying of the water from the condensing nozzle becomes larger in size, so that specific surface areas of the water droplets which contact with the humid air of high temperature are reduced. In the above state, the conventional drying apparatus does not achieve a desired condensing efficiency.

Furthermore, the conventional drying apparatus for the drum-type washing machines is designed to change the humid air of high temperature into dry air by using only the condensing nozzle. Therefore, the humidity of the air may not be reduced to a desired low level capable of efficiently drying the wet laundry.

Therefore, the conventional drying apparatus for the drum-type washing machines requires a long time to dry the wet laundry, thereby increasing electricity consumption. The laundry drying performance of the drum-type washing machines having the conventional drying apparatuses is thus deteriorated.

SUMMARY OF THE INVENTION

Accordingly, it is an aspect of the present invention to provide a drying apparatus to dry laundry and a washing machine including the drying apparatus, in which the drying apparatus quickly dries wet laundry by efficiently condensing and adsorbing vapor from high temperature humid air flowing from a water tub during a drying-mode operation.

Additional aspects and/or advantages of the invention will be set forth in part in the description which follows and, in part, will be obvious from the description, or may be learned by practice of the invention.

The above and/or other aspects are achieved by providing a drying apparatus, including a condensing duct provided on an outer surface of a water tub, the condensing duct having at least one air guide therein partitioning an inner space of the condensing duct into a plurality of condensing paths which communicate with each other in series.

The drying apparatus may further include an ultrasonic atomizing unit provided at a predetermined position in the plurality of condensing paths of the condensing duct so as to make fine water particles, thus promoting condensation of vapor from air flowing through the condensing duct.

The drying apparatus may further include a condensing nozzle provided at a predetermined position in the plurality of condensing paths of the condensing duct so as to spray water, thus promoting a condensation of vapor from air flowing through the condensing duct.

The drying apparatus may further include a water adsorption unit provided at a predetermined position in the plurality of condensing paths so as to adsorb vapor from air flowing through the condensing duct.

The water adsorption unit may be made of a material selected from a group including zeolite, alumina and silica.

The air guide may include a first air guide and a second air guide which are longitudinally arranged in the condensing duct between both sidewalls of the condensing duct, thus partitioning the inner space of the condensing duct into a first condensing path, a second condensing path and a third condensing path which communicate with each other in series, with an ultrasonic atomizing unit provided in the first condensing path, a condensing nozzle provided in the second condensing path, and a water adsorption unit provided in the third condensing path.

The air guide may include a first air guide and a second air guide which are longitudinally arranged in the condensing duct between both sidewalls of the condensing duct, thus partitioning the inner space of the condensing duct into a first condensing path, a second condensing path and a third condensing path which communicate with each other in series, with a first condensing nozzle provided in the first condensing path, a second condensing nozzle provided in the second condensing path, and a water adsorption unit provided in the third condensing path.

The drying apparatus may further include a blower duct provided on the outer surface of the water tub forming a closed air circulation circuit, in cooperation with both the water tub and the condensing duct, thus allowing air to pass through the closed air circulation circuit while drying laundry.

The drying apparatus may further include a blower fan and a heater provided in the blower duct feeding dry air of a high temperature into the water tub.

The above and/or other aspects are achieved by providing a drying apparatus, including a condensing duct provided on an outer surface of a water tub, and an ultrasonic atomizing unit provided in an inlet part of the condensing duct making fine water particles, thus promoting a condensation of vapor from air flowing through the condensing duct.

The ultrasonic atomizing unit may include a water container, a water supply pipe supplying water into the water container; and an oscillator provided in the water container producing ultrasonic waves.

The drying apparatus may further include a condensing nozzle provided in an intermediate part of the condensing duct spraying water, thus promoting the condensation of the vapor from the air.

The drying apparatus may further include a water adsorption unit provided in an outlet part of the condensing duct to adsorb water from the air discharged from the condensing duct.

The above and/or other aspects are achieved by providing a washing machine, including a water tub, and a drying apparatus provided on an outer surface of the water tub, the drying apparatus including a condensing duct provided on a rear surface of the water tub, and at least one air guide partitioning an inner space of the condensing duct into a plurality of condensing paths communicating with each other in series.

In the washing machine, the air guide may include a first air guide and a second air guide longitudinally arranged in the condensing duct partitioning the inner space of the condensing duct into a first condensing path, a second condensing path and a third condensing path.

In the washing machine, the drying apparatus may further include an ultrasonic atomizing unit provided in the first condensing path making fine water particles, thus condensing vapor from air passing through the first condensing path.

In the washing machine, the drying apparatus may further include a condensing nozzle provided in the second condensing path spraying water, thus condensing vapor from air passing through the second condensing path.

In the washing machine, the drying apparatus may further include a water adsorption unit provided in the third condensing path adsorbing vapor from air passing through the third condensing path.

In the washing machine, the drying apparatus may further include a blower duct provided on the outer surface of the water tub forming a closed air circulation circuit, in cooperation with both the water tub and the condensing duct, so that air to dry laundry passes through the closed air circulation circuit.

The washing machine may further include a blower fan and a heater provided in the blower duct feeding dry air of a high temperature into the water tub.

The above and/or other aspects are achieved by providing a drying apparatus, including a condensing duct condensing vapor from air, the condensing duct having an air guide therein.

In the drying apparatus, an inner space of the condensing duct may be partitioned by the air guide into a plurality of condensing paths communicating with each other in series.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
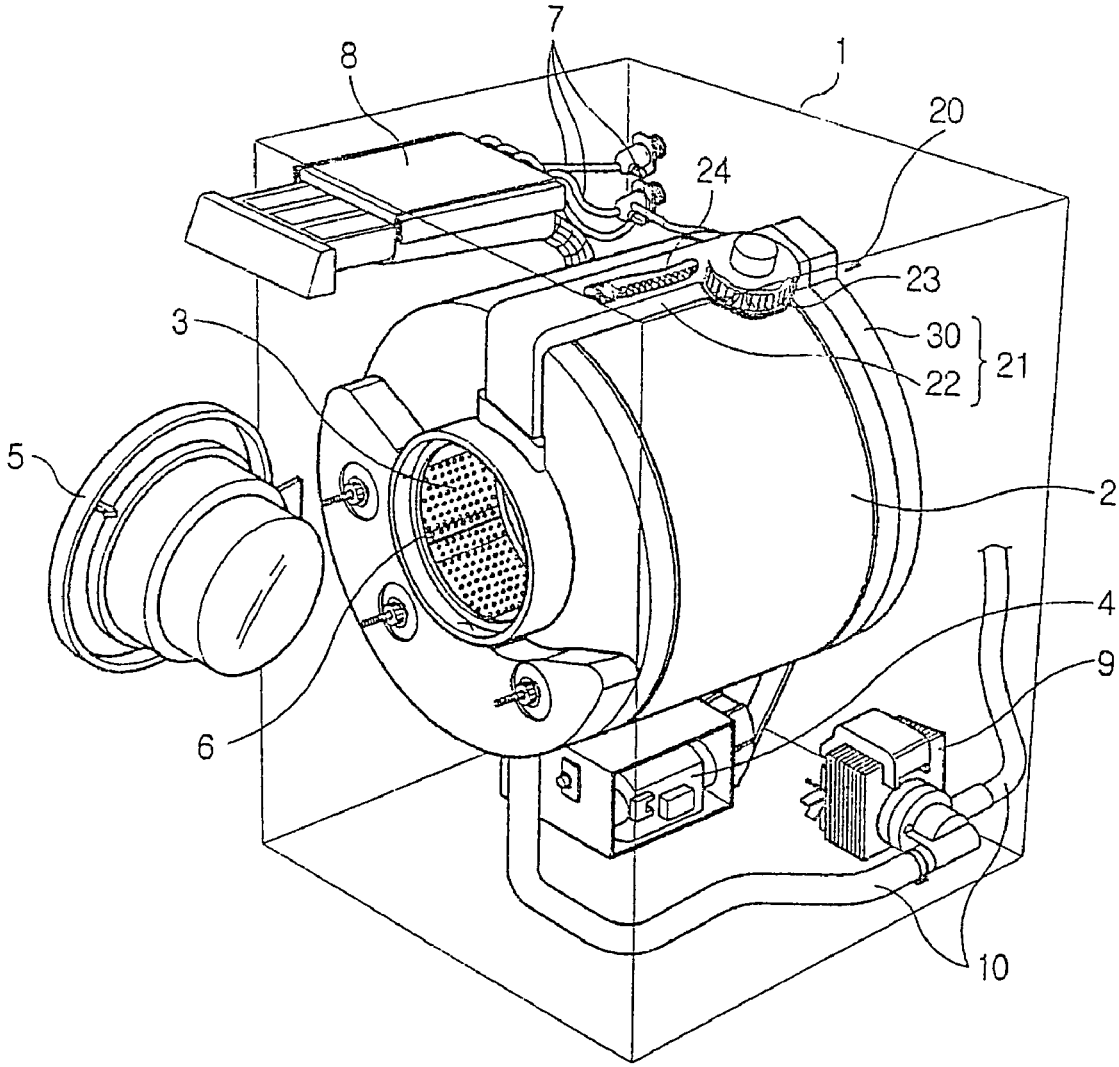
FIG. 1 is a perspective view of a drum-type washing machine having a drying apparatus, according to the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

Figure 2:
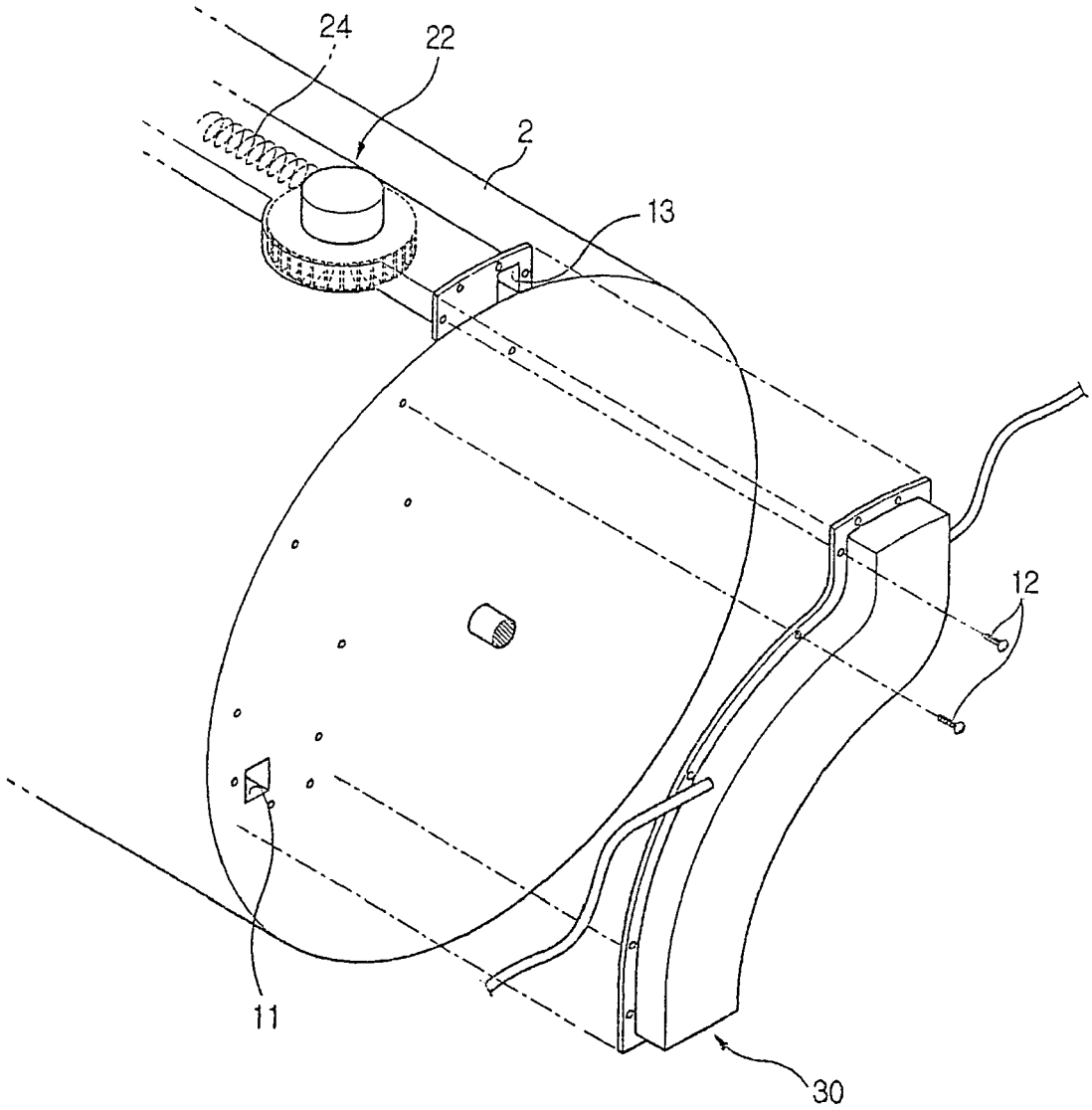
FIG. 2 is an exploded rear perspective view of a water tub of the drum-type washing machine of FIG. 1, which shows an arrangement of a condensing duct of the drying apparatus on a rear surface of the water tub.

FIG. 1 is a perspective view of a drum-type washing machine having a drying apparatus 20, according to the present invention. FIG. 2 is an exploded rear perspective view of a water tub 2 of the drum-type washing machine of FIG. 1, illustrating an arrangement of a condensing duct 30 of the drying apparatus 20 on a rear surface of the water tub 2.

As shown in FIG. 1, the drum-type washing machine according to the present invention includes a cabinet 1, a water tub 2, a rotary tub 3, and a drive motor 4. The cabinet 1 has a box shape and defines an appearance of the drum-type washing machine. The water tub 2 is horizontally installed in the cabinet 1 and contains washing water therein. The rotary tub 3 has a drum shape and is rotatably installed in the water tub 2, with a plurality of perforations formed around a sidewall of the rotary tub 3 to discharge water from the rotary tub 3 during a spin-drying-mode operation. The drive motor 4 rotates the rotary tub 3 to execute a washing-mode operation, a rinsing-mode operation and the spin-drying-mode operation.

The water tub 2 and the rotary tub 3 each have an opening at a front surface thereof allowing a user to place and remove laundry into and from the rotary tub 3. The drum-type washing machine further includes a door 5 mounted by a hinge to a front surface of the cabinet 1 to close the openings of the water tub 2 and the rotary tub 3. The rotary tub 3 has a plurality of lifters 6 arranged horizontally on an inner surface of the perforated sidewall of the rotary tub 3 at regular intervals, thus repeatedly moving the laundry upward together with the washing water to an upper position of a predetermined height. Eventually, the laundry drops from the upper position to a bottom position in an interior of the rotary tub 3 due to gravity. The laundry is thus washed.

The drum-type washing machine further includes a water supply hose 7 and a detergent container 8 in an upper portion of the cabinet 1. The water supply hose 7 supplies the washing water from an outside water source into the water tub 2, while the detergent container 8 contains a detergent therein to make detergent water by mixing the detergent with the washing water. The drum-type washing machine further includes a drain pump 9 and a drain hose 10 in a lower portion of the cabinet 1 to drain the washing water to an outside of the cabinet 1.

The drying apparatus 20 of the present invention is arranged on an outer surface of the cabinet 1 to quickly dry the wet laundry, which is placed in the rotary tub 3, by blowing dry air of high temperature onto the wet laundry during a drying-mode operation executed after the laundry has been completely washed, rinsed and spin-dried through the washing-mode operation, the rinsing-mode operation and the spin-drying-mode operation.

The drying apparatus 20 includes an air duct 21 forming an air circulation circuit, in cooperation with the interior of the water tub 3, so that the air drying the wet laundry circulates through the air circulation circuit which is a closed system, during the drying-mode operation of the drying apparatus 20. The drying apparatus 20 further includes a blower fan 23 and a heater 24 which are installed in the air duct 21 to forcefully circulate the air through the air circulation circuit and heat the air, respectively.

The air duct 21 includes a condensing duct 30 and a blower duct 22. The condensing duct 30 is provided on the rear surface of the water tub 2 so as to condense vapor from the high temperature humid air which passed through the water tub 2, thus dehumidifying the air producing dry air. The blower duct 22 is provided on an upper surface of the water tub 2 to feed the dry air form the condensing duct 30 to the water tub 2.

As shown in FIG. 2, the condensing duct 30 having a curved shape is attached to the rear surface of the cylindrical water tub 2 by a plurality of locking screws 12, such that the condensing duct 30 extends from a lower portion to an upper portion of the rear surface of the water tub 2, with an inner space of the condensing duct 30 communicating with the interior of the water tub 2 through an opening 11 formed on the rear surface of the water tub 2. The humid air, which passed through the water tub 2, flows upward along the inner space of the condensing duct 30, while the vapor of the humid air is condensed in the condensing duct 30. The air is thus dehumidified.

The blower duct 22 is arranged on the upper surface of the water tub 2, such that both ends of the blower duct 22 communicate with an upper end of the condensing duct 30 and a front end of the water tub 2, respectively, as shown in FIG. 1. The blower fan 23 and the heater 24 are installed in the blower duct 22 to forcefully circulate the air from the condensing duct 30 to the water tub 2 while changing the air from a cold, dry state into a hot, dry state.

Therefore, when the blower fan 23 and the heater 24 which are installed in the blower duct 22 are turned on, the air which sequentially passed through the water tub 2 and the condensing duct 30 is introduced into the blower duct 22, prior to being forcefully fed to the water tub 2. The air used to dry the wet laundry placed in the rotary tub 3 which is installed inside the water tub 2, thus repeatedly flows to the interior of the water tub 2 via both the condensing duct 30 and the blower duct 22.

A construction and operation of a drying apparatus 20 for drum-type washing machines according to a first embodiment of the present invention will be described herein below, with reference to FIGS. 3 to 5.

Figure 3:
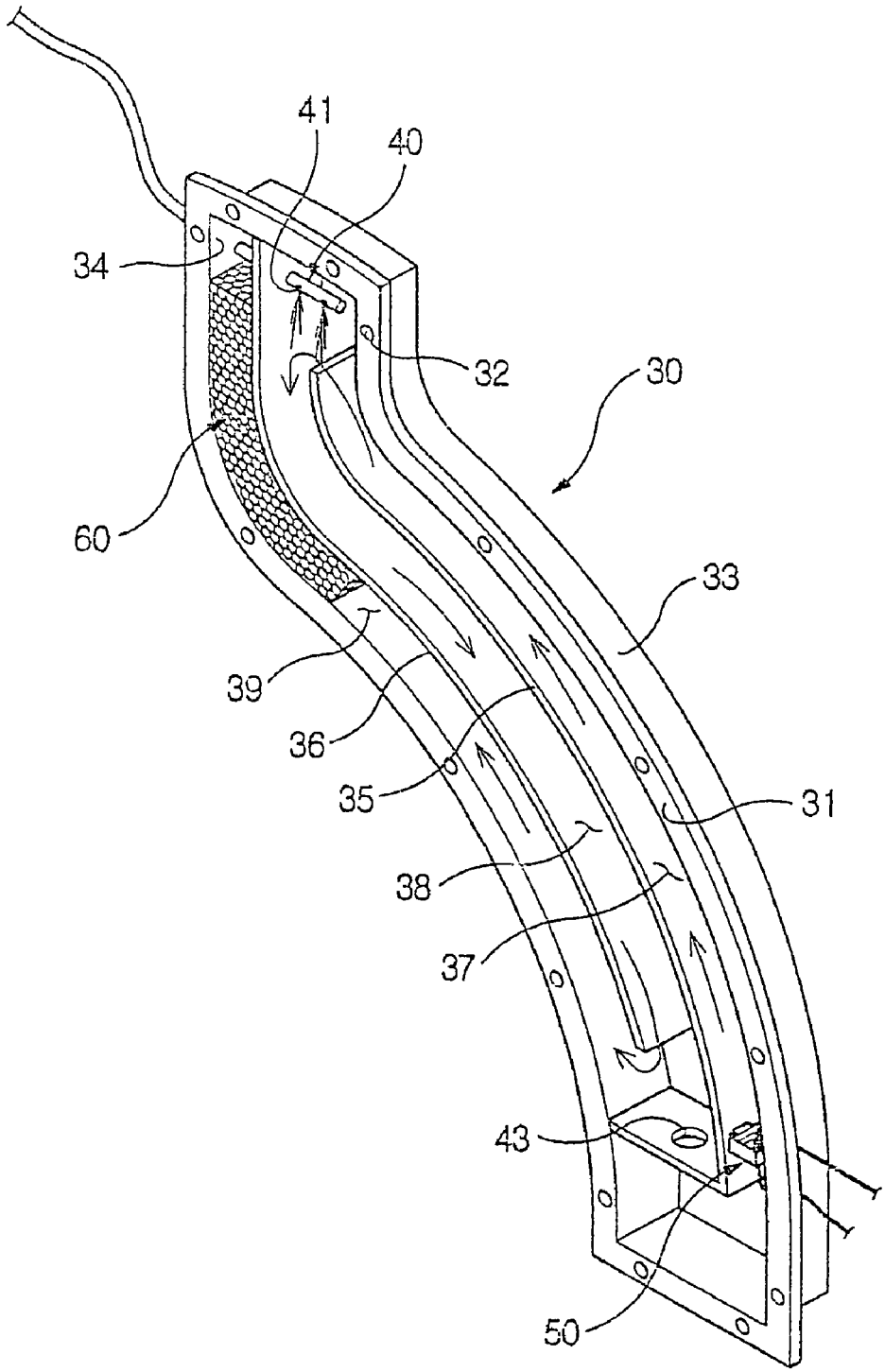
FIG. 3 is a perspective view illustrating an internal construction of a condensing duct of a drying apparatus for drum-type washing machines, according to an embodiment of the present invention.

FIG. 3 is a perspective view illustrating an internal construction of the condensing duct 30 of the drying apparatus 20, according to an embodiment of the present invention. FIG. 4 is a perspective view of a part of the condensing duct 30 of FIG. 3, illustrating a construction of an ultrasonic atomizing unit 50 provided in the condensing duct 30. FIG. 5 is a sectional view of a drum-type washing machine having the condensing duct 30 of FIG. 3, illustrating currents of air that circulate through both the drying apparatus 20 and the water tub 2 of the washing machine to dry wet laundry during a drying-mode operation.

As shown in FIG. 3, the condensing duct 30 according to an embodiment of the present invention has a curved shape, and is arranged on the rear surface of the water tub 2. The condensing duct 30 is open at a front thereof, thus forming an air path in cooperation with the inner space of the water tub 2, so that the air used to dry the wet laundry passes through the air path. The condensing duct 30 has a flange 31 of a predetermined width which continuously extends along an outside edge of the open front of the condensing duct 30, with a plurality of screw holes 32 formed along the flange 31. The condensing duct 30 is thus attached to the rear surface of the water tub 2 by the plurality of locking screws 12, as shown in FIG. 2. Of course, it should be understood that the condensing duct 30 may be attached to the rear surface of the water tub 2 via another means, such as a welding process, in place of the plurality of locking screws 12.

To guide the air in the condensing duct 30 such that the air flows upward and downward along a zigzag passage, in an effort to increase a vapor condensing time, the condensing duct 30 has a first air guide 35 and a second air guide 36 therein.

In the condensing duct 30, the first air guide 35 extends along a line spaced apart from a first sidewall 33 of the condensing duct 30. An upper end of the first air guide 35 terminates at a position spaced apart from an upper wall of the condensing duct 30, thus allowing the air to flow from a first condensing path 37 defined by the first air guide 35 to a second condensing path 38 defined by the second air guide 36. A lower end of the first air guide 35 extends horizontally to be mounted to a lower portion of a second sidewall 24 of the condensing duct 30.

The first condensing path 37 is thus defined between the first air guide 35 and the first sidewall 33 of the condensing duct 30, and communicates with the opening 11 formed on the rear surface of the water tub 2 (see FIG. 2). Therefore, the air, introduced into the condensing duct 30 through the opening 11 of the water tub 2, flows upward along the first condensing path 37.

In an embodiment of the present invention, the lower end of the first air guide 35 extends horizontally to be mounted to the lower portion of the second sidewall 34 of the condensing duct 30. However, the lower end of the first air guide 35 may extend downwardly to be mounted to a lower wall of the condensing duct 30, in place of the second sidewall 34.

The second air guide 36 extends along a curved channel between the first air guide 35 and the second sidewall 34 of the condensing duct 30. An upper end of the second air guide 36 is mounted to the upper wall of the condensing duct 30, while a lower end of the second air guide 36 is terminated at a position spaced apart from the lower end of the first air guide 35 which extends horizontally in the condensing duct 30.

Therefore, the second condensing path 38 is defined between the first air guide 35 and the second air guide 36, while a third condensing path 39 is defined between the second air guide 36 and the second sidewall 34 of the condensing duct 30.

Because the first, second and third condensing paths 37, 38 and 39 are defined in the condensing duct 30 by the first and second air guides 35 and 36, as described above, the air introduced from the opening 11 of the water tub 2 into the condensing duct 30 at a lower end of the first condensing path 37 primarily flows upward along the first condensing path 37 until a flowing direction of the air is reversed at an upper end of the first condensing path 37. Thereafter, the air flows downward along the second condensing path 38 to reach a lower end of the second condensing path 38 at which the flowing direction is reversed again. Thereafter, the air flows upward along the third condensing path 39 to reach an upper end of the third condensing path 39. In brief, the air passes in the condensing duct 30 through the zigzag passage formed by the first, second and third condensing paths 37, 38 and 39, increasing the flowing time of the air within the condensing duct 30. The vapor of the air is thus sufficiently condensed within the condensing duct 30 even though the condensing duct 30 is short.

Because the upper end of the third condensing path 39 of the condensing duct 30 is aligned with a communicating hole 13 which is formed at a rear end of the blower duct 22 as shown in FIG. 2, the air which sequentially passed through the first, second and third condensing paths 37, 38 and 39 of the condensing duct 30, is introduced into the blower duct 22 through the communicating hole 13.

To condense and adsorb the vapor from the air flowing in the condensing duct 30, and to thereby dehumidify the air, the ultrasonic atomizing unit 50 is provided in the first condensing path 37, and a water adsorption unit 60 is provided in the third condensing path 38. To further condense the vapor from the air that passed through the first condensing path 37 in which the vapor of the air was primarily condensed by the ultrasonic atomizing unit 50, a condensing nozzle 40 is provided in the second condensing path 38.

In a brief description of the condensing duct 30 of the first embodiment, the ultrasonic atomizing unit 50 is installed in the first condensing path 37, the condensing nozzle 40 is installed in the second condensing path 38, and the water adsorption unit 60 is installed in the third condensing path 39. Therefore, the vapor of the humid air of high temperature flowing from the water tub 2 is condensed and adsorbed while the air sequentially passes through the first, second and third condensing paths 37, 38 and 39, so that the condensing duct 30 quickly and efficiently dehumidifies the air, thus providing the air of low temperature and low humidity.

The ultrasonic atomizing unit 50 is installed in a lower portion of the first condensing path 37 making fine water particles, thus cooling the air and condensing the vapor from the air while the air flows upward along the first condensing path 37. The ultrasonic atomizing unit 50 thus primarily reduces the humidity of the air.

Figure 4:
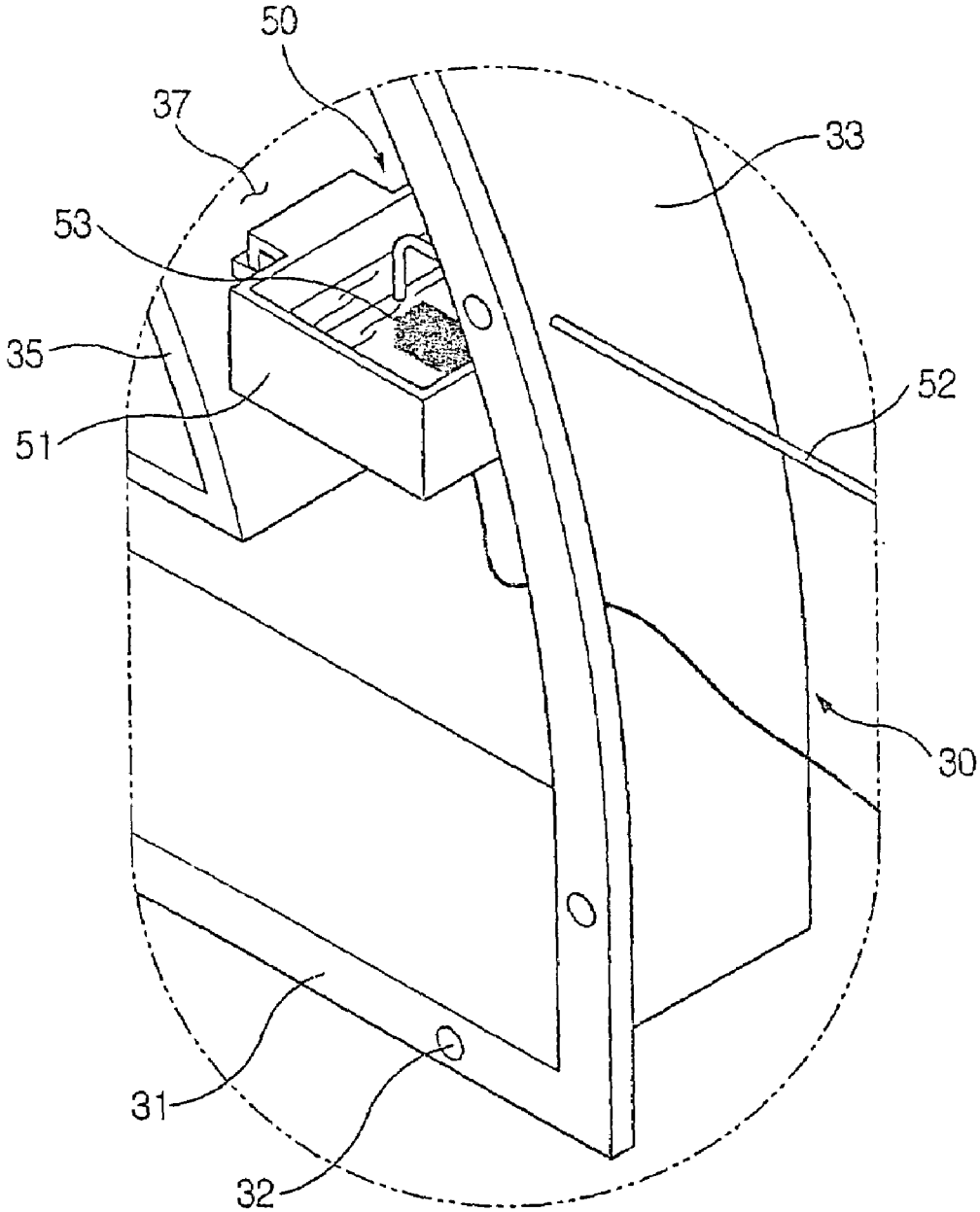
FIG. 4 is a perspective view of a part of the condensing duct of FIG. 3, illustrating a construction of an ultrasonic atomizing unit provided in the condensing duct.
Figure 5:
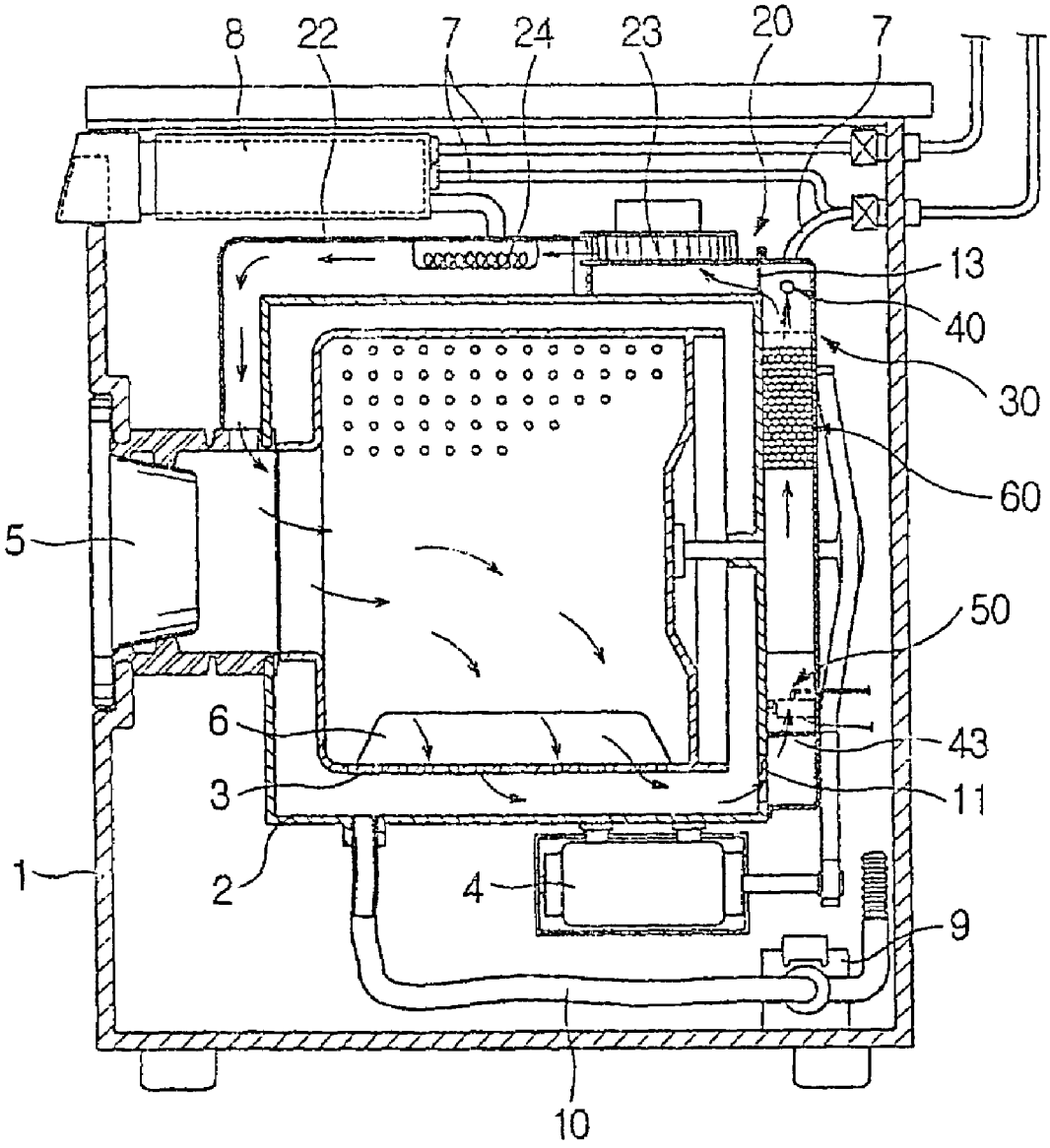
FIG. 5 is a sectional view of a drum-type washing machine having the condensing duct of FIG. 3, illustrating currents of air circulating through both the drying apparatus and the water tub of the washing machine drying wet laundry during a drying-mode operation.

As shown in FIG. 4, the ultrasonic atomizing unit 50 includes a water container 51 to contain a predetermined amount of water therein, a water supply pipe 52 to supply water into the water container 51, and an oscillator 53 which is provided in a lower portion of the water container 51 to produce ultrasonic waves. The ultrasonic atomizing unit 50 is installed in the lower portion of the first condensing path 37 by mounting opposite sidewalls of the water container 51 to the first air guide 35 and the first sidewall 33 of the condensing duct 30, respectively.

During operation of the drying apparatus 20 having the condensing duct 30, the oscillator 53 of the ultrasonic atomizing unit 50 produces microwaves when the oscillator 53 is turned on. Due to the microwaves, fine water particles are produced in the water contained in the water container 51, and come into contact with the humid air which flows through the first condensing path 37, thus condensing the vapor from the humid air and primarily reducing the humidity of the air.

The condensing nozzle 40 is installed in an upper portion of the second condensing path 38 while being coupled to the water supply hose 7 which supplies the washing water from the outside water source into the water tub 2 (see FIG. 1). The condensing nozzle 40 has a plurality of spraying holes 41 at an end thereof to spray the water from the spraying holes 41 downward at a high speed. When the air, of which the vapor was primarily condensed by the ultrasonic atomizing unit 50 within the first condensing path 37, flows downward along the second condensing path 38, the air is cooled again and i the humidity is secondarily reduced thereof due to a condensation of the vapor of the air by the water sprayed from the condensing nozzle 40.

The water adsorption unit 60 installed in an upper portion of the third condensing path 39 has a porous structure made of a material selected from a group including zeolite, alumina and silica. When the air flowing from the second condensing path 38 passes through the third condensing path 39, the water adsorption unit 60 adsorbs remaining vapor and/or mist from the air, thus changing the humid state of the air into a dry state before the air is introduced into the blower duct 22.

The first air guide 35 has a drain hole 43 at the horizontal lower end thereof to discharge collected water from the lower end of the first air guide 35 to a bottom of the condensing duct 30. Therefore, the water produced from the condensations in the second and third condensing paths 38 and 39 is collected on an inner surface of the lower end of the first air guide 35, and is discharged to the bottom of the condensing duct 30 through the drain hole 43, so as to be mixed with water produced from the condensation in the first condensing path 37 and collected on the bottom of the condensing duct 30. The collected water is, thereafter, fed from the bottom of the condensing duct 30 into the water tub 2 through the opening 11 of the water tub 2, and is drained to an outside of the cabinet 1 through a drain hose 10 (see FIG. 1).

As described above, the condensing duct 30 according to an embodiment of the present invention has the two air guides, which are the first and second air guides 35 and 36, defining three condensing paths, which are the first, second and third condensing paths 37, 38 and 39, within the condensing duct 30. However, it should be understood that the numbers of the air guides of the condensing duct 30 may be changed and an additional condensing means may be installed in the condensing duct 30 to enhance a condensation effect of the condensing duct 30, without affecting the functioning of the present invention.

The above-mentioned drying apparatus 20 according to an embodiment of the present invention operates as follows to dry the wet laundry.

When the laundry has been completely washed, rinsed and spin-dried by the drum-type washing machine having the drying apparatus 20 according to an embodiment, the rotary tub 3 rotates at a low speed, and both the blower fan 23 and the heater 24 of the drying apparatus 20 are turned on to execute the drying-mode operation.

When the blower fan 24 rotates, the high temperature humid air flows from the inner space of the water tub 2 into the first condensing path 37 of the condensing duct 30 through the opening 11. While the high temperature humid air flows upward in the first condensing path 37, the humid air comes into contact with the low temperature fine water particles produced by and forced upward by the ultrasonic atomizing unit 50. The humid air is thus cooled, and a part of the vapor of the humid air is condensed by the fine water particles, so that the humidity of the air is primarily reduced. In the above state, the water produced from the condensation in the first condensing path 37 drops downward onto the bottom of the condensing duct 30. The air having reduced humidity is primarily reduced flows from the first condensing path 37 into the second condensing path 38.

When the air flows downward along the second condensing path 38, the air comes into contact with the water particles sprayed from the spraying holes 41 of the condensing nozzle 40 which is arranged in the upper portion of the second condensing path 38, so that the air is cooled again. Therefore, remaining vapor in the air is condensed, reducing the humidity of the air is secondarily reduced to a very low level while the air passes through the second condensing path 38.

The air is, thereafter, introduced into the third condensing path 39 wherein the air flows upward to pass through the water adsorption unit 60 that is installed in the upper portion of the third condensing path 39. Therefore, the water adsorption unit 60 adsorbs the remaining vapor and/or mist from the air, thus providing low temperature dry air.

The low temperature dry air passed through the water adsorption unit 60 is, thereafter, introduced into the blower duct 22 through the communicating hole 13 that is formed at the rear end of the blower duct 22. While the lower temperature dry air passes through the blower duct 22, the dry air is heated by the heater 24, providing high temperature dry air. The high temperature dry air is then introduced into a front surface of the water tub 2 to dry the wet laundry placed in the rotary tub 3.

During the above-mentioned drying-mode operation, the water produced from the condensations in the second and third condensing paths 38 and 39 is discharged to the bottom of the condensing duct 30 through the drain hole 43 which is formed on the horizontal lower end of the first air guide 35. The water from the second and third condensing paths 38 and 39 is, thereafter, fed into the water tub 2 through the opening 11 of the water tub 2, along with the water produced from the first condensing path 37.

During the drying-mode operation of the drum-type washing machine having the drying apparatus 20 according to an embodiment of the present invention, the humid air flowing from the water tub 2 primarily passes through the condensing duct 30 while being dehumidified by the ultrasonic atomizing unit 50, the condensing nozzle 40 and the water adsorption unit 60. The air secondarily passes through the blower duct 22 while being heated by the heater 24, thus becoming high temperature dry air, prior to being introduced into the water tub 2 to dry the wet laundry placed in the rotary tub 3. Because the above-mentioned circulation of the air continues during the drying-mode operation, the wet laundry is quickly dried.

In the present invention, a heater (not shown) may be installed under the water adsorption unit 60 to remove adsorbed water from the water adsorption unit 60 during or after the drying-mode operation.

A construction and operation of a drying apparatus 20 for drum-type washing machines according to another embodiment of the present invention will be described herein below, with reference to FIGS. 6 and 7.

Figure 6:
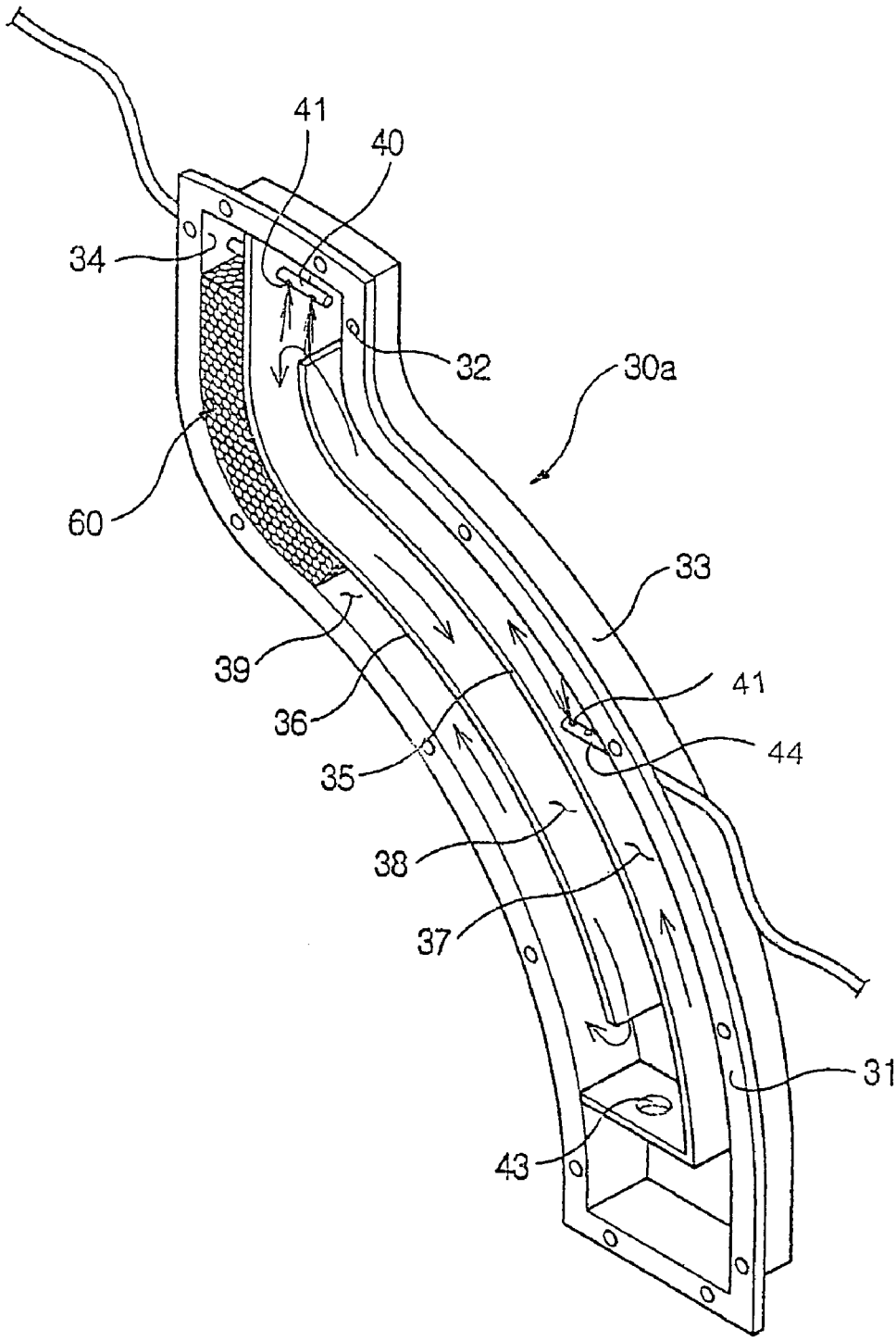
FIG. 6 is a perspective view illustrating an internal construction of a condensing duct of a drying apparatus, according to a second embodiment of the present invention.
Figure 7:
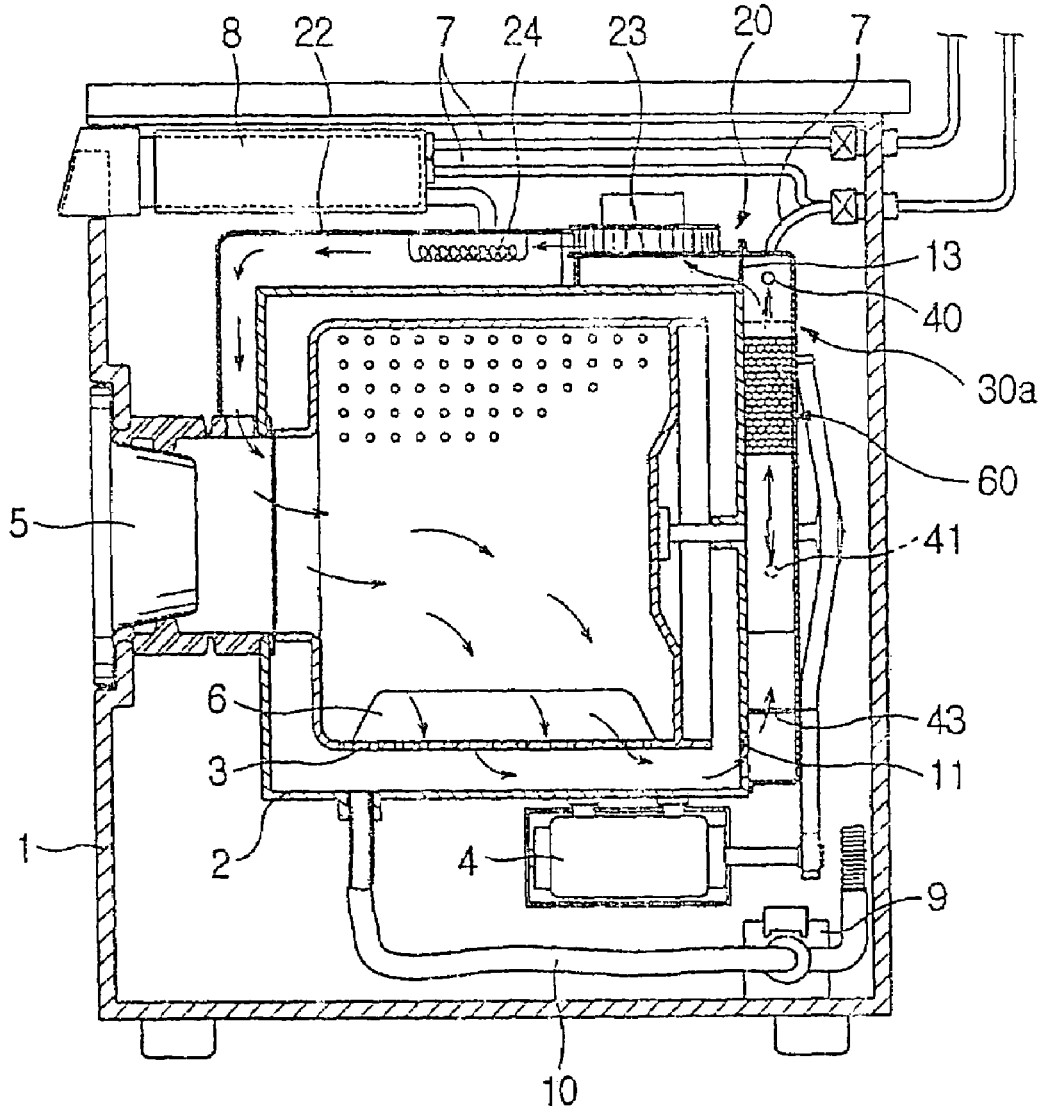
FIG. 7 is a sectional view of a drum-type washing machine having the condensing duct of FIG. 6, illustrating currents of air circulating through both the drying apparatus and the water tub of the washing machine drying wet laundry during a drying-mode operation.

FIG. 6 is a perspective view illustrating an internal construction of a condensing duct 30*a* of the drying apparatus 20, according to another embodiment of the present invention. FIG. 7 is a sectional view of a drum-type washing machine having the condensing duct 30*a* of FIG. 6, illustrating currents of air that circulate through both the drying apparatus 20 and the water tub 2 of the washing machine to dry wet laundry during a drying-mode operation.

As shown in FIG. 6, a general shape of the condensing duct 30*a* according to another embodiment of the present invention remains the same as that described for the condensing duct 30 of the first embodiment, except for a condensing nozzle 44 that is installed in the first condensing path 37 in place of the ultrasonic atomizing unit 50. Therefore, in the following description, a further explanation for the same elements of the first and second embodiments is not deemed necessary.

In the condensing duct 30*a* according to another embodiment, the condensing nozzle 44 which will be referred to as the first condensing nozzle herein below is installed in an intermediate portion of the first condensing path 37 to condense the vapor from the humid air, which flows through the condensing duct 30*a,* thus dehumidifying the air in cooperation with both the condensing nozzle 40 which is installed in the upper portion of the second condensing path 38 and will be referred to as the second condensing nozzle, and the water adsorption unit 60 which is installed in the upper portion of the third condensing path 39.

In the same manner as that described for the second condensing nozzle 40 within the second condensing path 38, the first condensing nozzle 44 is coupled to the water supply hose 7 (see FIG. 1), so that the water is fed to the first condensing nozzle 44. The first condensing nozzle 44 has a plurality of spraying holes 41 at an end thereof to spray the water from the spraying holes 41 upward at a high speed.

In an operation of the drying apparatus 20 having the condensing duct 30*a,* the high temperature humid air flows from the water tub 2 into the first condensing path 37 of the condensing duct 30 by a blowing force of the blower fan 23. While the high temperature humid air flows upward through the first condensing path 37, the humid air comes into contact with water particles of low temperature sprayed upward from the spraying holes 41 of the first condensing nozzle 44, so that a part of the vapor of the humid air is condensed to primarily reduce the humidity of the air. The air is, thereafter, introduced into the second condensing path 38.

When the air, of which the vapor was primarily condensed by the first condensing nozzle 44 within the first condensing path 37, flows downward along the second condensing path 38, the air is cooled again and the vapor of the air is secondarily condensed by the water particles sprayed from the spraying holes 41 of the second condensing nozzle 40. Therefore, remaining vapor in the air is condensed, further reducing the humidity of the air to a very low level while the air passes through the second condensing path 38.

The air is, thereafter, introduced into the third condensing path 39 wherein the air flows upward to pass through the water adsorption unit 60 that is installed in the upper portion of the third condensing path 39. The water adsorption unit 60 adsorbs the remaining vapor and/or mist from the air, thus providing low temperature dry air.

The low temperature dry air passed through the water adsorption unit 60 is, thereafter, introduced into the blower duct 22 through the communicating hole 13 that is formed at the rear end of the blower duct 22. While the lower temperature dry air passes through the blower duct 22, the dry air is heated by the heater 24, producing high temperature dry air. The high temperature dry air is then introduced into the front surface of the water tub 2 to dry the wet laundry placed in the rotary tub 3.

As apparent from the above description, the present invention provides a drying apparatus and a washing machine having the drying apparatus. In the drying apparatus, a plurality of condensing paths are defined in a condensing duct, with an ultrasonic atomizing unit, a condensing nozzle and a water adsorption unit respectively installed in the condensing paths. When humid air, which passed through a water tub of the washing machine to dry wet laundry, flows upward and downward through the condensing paths of the condensing duct while vapor of the humid air is repeatedly condensed, the humidity of the air is quickly reduced quickly providing the dry air. Therefore, the washing machine having the drying apparatus of the present invention reduces a drying time and saves electricity, due to a reduction in the operational time of a heater, while drying the laundry during a washing operation.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing machine, comprising:

a water tub; and a drying apparatus provided on an outer surface of the water tub, the drying apparatus including:

a condensing duct provided on a rear surface of the water tub; and at least a pair of air guides comprising a first air guide and a second air guide which are longitudinally arranged in the condensing duct so as to partition the inner space of the condensing duct into a first condensing path, a second condensing path, and a third condensing path, the first and third condensing paths in communication with each other through the second condensing path, wherein air in the first condensing path travels in a first vertical direction, air in the second condensing path travels in a second vertical direction opposite the first vertical direction, and air traveling in the third condensing path travels in the first vertical direction.

2. The washing machine according to claim 1, wherein the drying apparatus further comprises:

an ultrasonic atomizing unit provided in the first condensing path to make fine water particles, thus condensing vapor from air which passes through the first condensing path.

3. The washing machine according to claim 1, wherein the drying apparatus further comprises:

a condensing nozzle provided in the second condensing path to spray water, thus condensing vapor from air which passes through the second condensing path.

4. The washing machine according to claim 1, wherein the drying apparatus further comprises:

a water adsorption unit provided hi the third condensing path to adsorb vapor from air which passes through the third condensing path.

5. The washing machine according to claim 1, wherein the drying apparatus further comprises:

a blower duct provided on the outer surface of the water tub to form a closed air circulation circuit, in cooperation with both the water tub and the condensing duct, so that air to dry laundry passes through the dosed air circulation circuit.

6. The washing machine according to claim 5, further comprising:

a blower fan and a heater provided in the blower duct to feed dry air of a high temperature into the water tub.

7. A drying apparatus for a washing machine, comprising:

a condensing duct provided on a rear surface of a water tub; and at least a pair of air guides comprising a first air guide and a second air guide which are longitudinally arranged in the condensing duct so as to partition the inner space of the condensing duct into a first condensing path, a second condensing path, and a third condensing path, the first and third condensing paths in communication with each other through the second condensing path.

wherein air in the first condensing path travels in a first vertical direction, air in the second condensing path travels in a second vertical direction opposite the first vertical direction, and air traveling in the third condensing path travels in the first vertical direction.

* * * * *

UNITED STATES PATENT AND TRADEMARK OFFICE

CERTIFICATE OF CORRECTION

PATENT NO. : 7,017,282 B2
APPLICATION NO. : 10/800730
DATED : March 28, 2006
INVENTOR(S) : Sang-Yeon Pyo et al.

It is certified that error appears in the above-identified patent and that said Letters Patent is hereby corrected as shown below:

Column 12, line 61, change “hi” to --in--

Column 13, line 2, change “dosed” to --closed--

Column 14, line 5, change “path.” to --path,--

Signed and Sealed this

Twelfth Day of September, 2006

JON W. DUDAS
*Director of the United States Patent and Trademark Office*